US006970900B2

(12) United States Patent
Johnson

(10) Patent No.: US 6,970,900 B2
(45) Date of Patent: Nov. 29, 2005

(54) OPTICAL SYSTEM FOR CERTAIN MATHEMATICAL OPERATIONS

(75) Inventor: John L. Johnson, Heidelberg (DE)

(73) Assignee: The United States of America as represented by the Secretary of the Army, Washington, DC (US)

( * ) Notice: Subject to any disclaimer, the term of this patent is extended or adjusted under 35 U.S.C. 154(b) by 709 days.

(21) Appl. No.: 10/051,732

(22) Filed: Jan. 22, 2002

(65) Prior Publication Data

US 2003/0137707 A1 Jul. 24, 2003

(51) Int. Cl.[7] ..... G06G 7/00; G06G 3/00
(52) U.S. Cl. ..... 708/801; 708/816
(58) Field of Search ..... 708/800, 801, 708/816

(56) References Cited

U.S. PATENT DOCUMENTS 5,598,053 A 1/1997 Johnson et al. ..... 313/364
5,784,309 A 7/1998 Budil ..... 708/835

*Primary Examiner*—Tan V. Mai

(57) ABSTRACT

An optical system utilizing phosphors to perform mathematical operations without the direct or necessary use of an electronic component or electrical power source is disclosed. The luminenscent and quenching properties of phosphors are combined with at least one first-order relaxation subsystem such that when the optical system achieves equilibrium, it will have performed certain mathematical operations. The precise mathematical operation to be performed is determined by controlling the materials utilized, light inputs, and certain variables within the optical system.

8 Claims, 1 Drawing Sheet

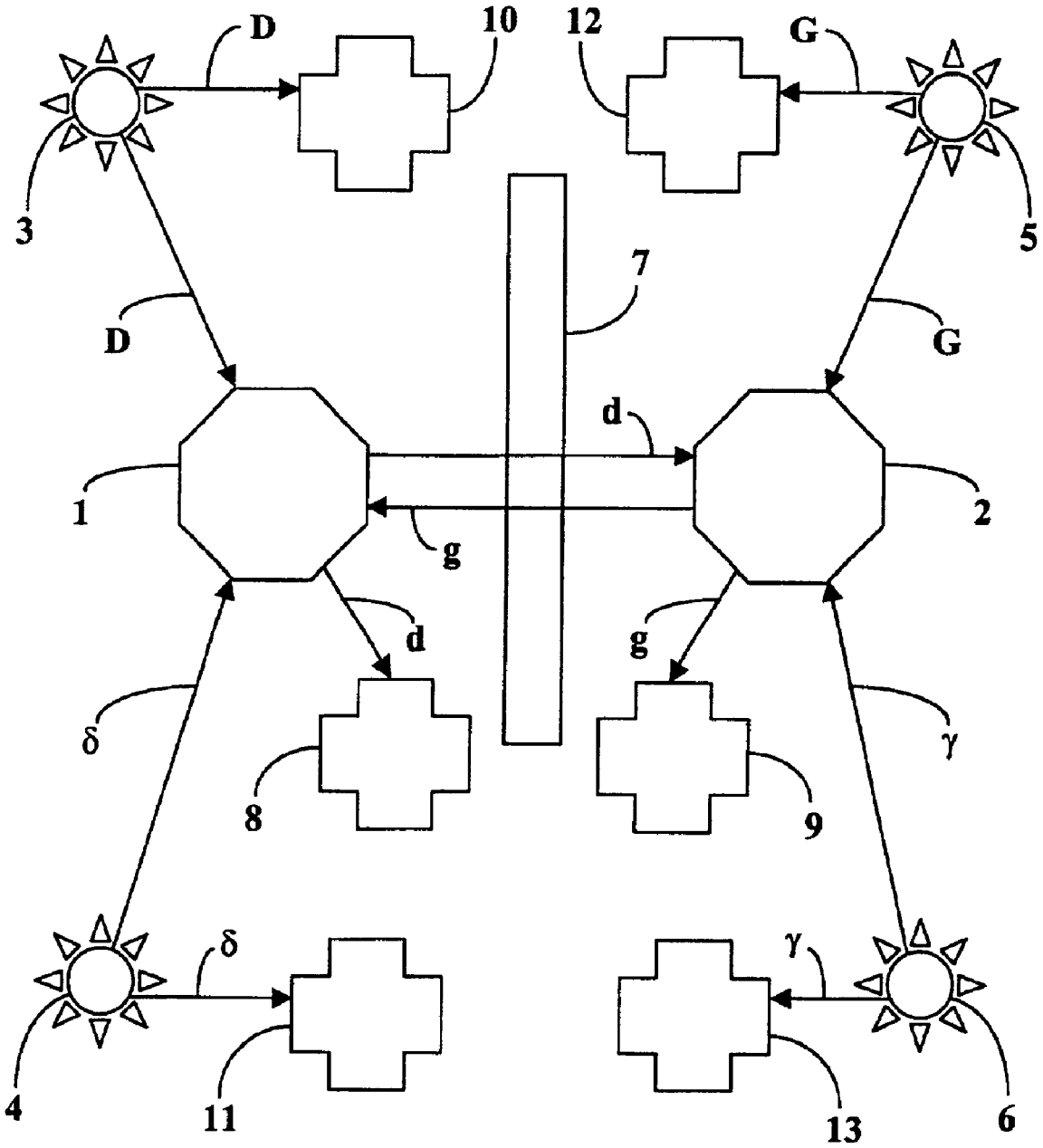
D
10
12
G
3
5
7
D
G
d
1
2
g
d
g
δ
γ
8
9
δ
γ
4
11
13
6

OPTICAL SYSTEM FOR CERTAIN MATHEMATICAL OPERATIONS

DEDICATORY CLAUSE

The invention described herein may be manufactured, used and licensed by or for the Government for governmental purposes without the payment to me of any royalties thereon.

BACKGROUND OF THE INVENTION

Optical systems that perform mathematical operations other than addition are difficult to construct because of two fundamental facts. First, light intensity is a positive-definite physical quantity. While electrical voltage can be positive or negative, light intensity can only be positive or zero. Second, photons can be created and destroyed at will in optical systems. In electrical systems, electrons are conserved. The nonlinear optical effects which are most often associated with multiplication are primarily contained in the third-order dependence of the electrical susceptibility on the electrical field incident optical wave(s). (First-order gives birefringence, second-order gives photoelectrons, and third-order produces photorefractive effects.) The optical system described herein uses second-order effects to perform certain mathematical operations. One such second-order effect is the quenching effect described in U.S. Pat. No. 5,598,053 issued Jan. 28, 1997. In this patent, the quenching effect is modeled as an induced increase to the natural decay rate of the phosphor where the added increase is proportional to the intensity of the quenching illumination.

By combining the luminenscent and quenching properties of phosphors with first-order relaxation subsystems, certain mathematical operations can be performed. The optical system described will enable collective dynamic behaviors such that the relative strengths of the output light intensities (as compared to those of the input light intensities) correspond to the results that would be achieved by performing certain mathematical computations with numbers in the same relative proportions to each other (as the input and output light intensities). By measuring the light intensities, the equivalent computational answers can be obtained from the system. The potential equivalent computations include all mathematical operations describable by the physics that apply to the specific optical system of interacting light intensities and phosphor materials.

The prior art for computational systems employing optical components all appears to rely upon electrical power, electrical components or both. See, for example, U.S. Pat. No. 5,784,309 issued Jul. 21, 1998. While U.S. Pat. No. 5,784,309 and others may employ a damping force in their process, no prior art was found which utilizes the second-order susceptibility effects (to include quenching) as an integral part of the mathematical computation and variables.

The present invention uniquely and separately teaches: the combination of multiple phosphors in not less than two first-order relaxation subsystems to perform mathematical operations; the utilization of the second-order effects (e.g., quenching) of phosphor to perform mathematical operations; the combining of the not less than two first-order relaxation subsystems with the second-order effects (e.g., quenching) of phosphor to perform mathematical operations; and the ability to perform any or all of the above teachings without the necessity of electrical power or components.

A significant potential benefit of an all-optical (non-electric) system is its application to isolated environments (e.g., space exploration) where a limited power supply must be considered in all planning and design activities.

SUMMARY OF THE INVENTION

This optical system utilizes second-order susceptibility effects of phosphors to perform mathematical operations without the direct use of an electronic component or electrical power source. The luminenscent and quenching properties of phoshors are combined with at least one first-order relaxation subsystem such that the output will be a function of its inputs and will be equivalent to having performed certain mathematical operations on the inputs. The mathematical operation can be chosen by specifying which inputs are present. The precise mathematical operation to be performed is determined by controlling the materials utilized, light inputs, and certain variables within the optical system. A specific application may require a means for controlling light inputs, a means for measuring light emitted, and a means for adjusting variables.

DESCRIPTION OF THE DRAWING

The single FIGURE shows the components and light paths for the preferred embodiment.

DESCRIPTION OF THE PREFERRED EMBODIMENT

Referring now to the drawing wherein like numbers represent like parts, the following is the preferred embodiment of the invention.

The embodiment shown in the FIGURE contains a first phosphor 1 and a second phosphor 2 in promixity to each other such that the light emitted by each of the phosphors (if not otherwise controlled) strikes the other phosphor. A first excitatory light source 3 and a first quenching light source 4 are positioned so that their light strikes only the first phosphor 1 and not the second phosphor 2. A second excitatory light 5 and a second quenching light 6 are positioned so that their light strikes only the second phosphor 2 and not the first phosphor 1. An adjusting means 7 for varying the coupling strength between the first phosphor 1 and the second phosphor 2 is positioned in proximity to (e.g., between) the first phosphor 1 and the second phosphor 2. Quantifying means 8, 9, 10, 11, 12, and 13 for measuring, respectively, the intensity of the first phosphor 1, the second phosphor 2, the first excitatory light source 3, the first quenching light source 4, the second excitatory light source 5, and the second quenching light source 6 are positioned such that only the light emitted by the respective source is measured.

As warranted by the environment and actual method of construction, additional baffling means (not shown herein) may be added to assure that light external to the optical system does not strike any light sentsitive component and that light internal to the optical system strikes only those light sensitive components intended to receive such light.

Coupling strength is the factor derived from the intensity of the light emitted by phosphor 2 striking the first phosphor 1 divided by the intensity of that same light when it was emitted from the second phosphor 2. The value of the coupling strength can vary from zero to a positive fraction to any positive number (if amplification is desired). The optical system herein described has only one coupling strength due to the design. However, other embodiments might utilize multiple, different coupling strengths. The adjusting means could be, for example, a simple filter or screen or a device for altering distance between the two phosphors where such adjusting means is fixed as to the amount of the adjustment in the coupling strength during a mathematical operation. The adjusting means may be a more complex arrangement having the ability to vary the coupling strength during operation. Such varying adjustment means would allow the coupling strength to be a variable in a specific mathematical operation.

Adjusting means, baffling means, excitatory means, and quantifying means are well-known in the art and are not further described herein. Baffling means as used in the claim is not limited to physical structures. It includes any means for preventing a source of light from interfering with another source of light or from illuminating a light sensitive component.

For discussion purposes, the various emitted lights are shown by arrows and are labeled as follows: emitted from the first excitatory light source 3 towards the first phosphor 1 and the quantifying means 10 is light D; emitted from the first quenching light source 4 towards the first phosphor 1 and the quantifying means 11 is light δ; emitted from the first phosphor 1 towards the second phosphor 2 and the quantifying means 8 is light d; emitted from the second excitatory light source 5 towards the second phosphor 2 and the quantifying means 12 is light G; emitted from the second quenching light source 6 towards the second phosphor 2 and the quantifying means 13 is light γ; and emitted from the second phosphor 2 towards the first phosphor 1 and the quantifying means 9 is light g. The various lights emitted within the preferred embodiment will be incoherent light to eliminate any interference effects. Coherent light may be used as long as the potential for unintentional interference is eliminated by the system's design or operation.

Various mathematical operations may be performed by this optical system. The two phosphors are, in effect, a coupled system of two first-order relaxation subsystems. The following examples of such mathematical operations are provided without limitation. In a first example, a division function is performed when the coupling strength K is adjusted to zero (essentially reducing the optical system to a single phosphor system). When the optical system embodiment described by the first example reaches a steady state, the steady state emitted light d is equal to the intensity of excitatory light D divided by the sum of the quenching light δ and the intrinsic decay rate $k_0$. In a second example, an addition function may be performed by employing both phosphors. By preselecting an intrinsic decay rate value of 0.25, a value for delta of 1.75, a value for gamma of 0.75, and a value for the coupling strength of 1.0, at a steady state condition the emitted light d will be equal to the sum of the excitatory lights D and G.

The preferred embodiment employs adjusting means, baffling means, excitatory means, and quantifying means that do not require electronic components. The preferred embodiment allows for a wide range of mathematical operations limited by the physic applications. Such potential physic applications include, without limitation, equilibrium and steady-state outputs as well as transient dynamic outputs, linear and non-linear operations, one or more systems or subsystems, multiple types of phosphor objects having the same or varying physical or chemical properties, all wavelengths of coherent and incoherent light, and all levels of computational complexity.

In the preferred embodiment, several of the components are represented by a means for accomplishing a specified function. Any means known and used for any similar functions may be substituted as an equivalent for the above described means.

Although a particular embodiment and form of the optical system has been illustrated, it is apparent that various modifications and embodiments of the optical system may be made by those skilled in the art without departing from the scope and spirit of the foregoing disclosure. Accordingly, the scope of the optical system should be limited only by the claims appended hereto.

The optical system disclosed may be used in lieu of other systems when the mathematical operation to be performed can be modeled by the phyics of the optical system components. This may be especially useful for modeling other relaxation systems and their interactions. The ability to perform such mathematical operations without the need of a power source, other than light, has potential applications in outer space exploration and other isolated environments.

As with other significant inventions (e.g., use of manual and then electronic componets to perform mathematical operations), once the concept has been disclosed, a variety of applications will be obvious to those skilled in the various arts affected.

I claim:

1. An optical system for performing mathematical operations, the system comprising: a plurality of phosphor objects positioned such that the objects may receive the light from at least one other object; an exciting means positioned in proximity to the objects for exciting at least one of the objects with light having a known intensity which may be selectively varied; and quantifying means positioned in proximity to the objects and to the exciting means for determining the intensity of at least one object and at least one exciting means.

2. The system as described in claim 1, further comprising a quenching means for altering the luminescence of at least one of the objects and positioned in proximity to the objects to be affected such that the light from the quenching means will affect only the intended objects.

3. The system as described in claim 2, further comprising an adjusting means for varying the coupling strength between at least one combination of at least two of the interacting objects from zero to the value appropriate for the given application and being positioned in proximity to the interacting objects so as to accomplish the adjustment.

4. The system as described in claim 3, further comprising a baffling means integrated into the system for assuring that any source of light affects only the objectives preselected to receive that specific light.

5. The system as described in claim 2, further comprising a baffling means integrated into the system for assuring that any source of light affects only the objectives preselected to receive that specific light.

6. The system as described in claim 1, further comprising an adjusting means for varying the coupling strength between at least one combination of at least two of the interacting objects from zero to the value appropriate for the given application and being positioned in proximity to the interacting objects so as to accomplish the adjustment.

7. The system as described in claim 6, further comprising a baffling means integrated into the system for assuring that any source of light affects only the objectives preselected to receive that specific light.

8. The system as described in claim 1, further comprising a baffling means integrated into the system for assuring that any source of light affects only the objectives preselected to receive that specific light.

* * * * *